US005368333A

United States Patent [19]

Arroyo

[11] Patent Number: 5,368,333

[45] Date of Patent: Nov. 29, 1994

[54] LOOSE LEAF BINDER

[76] Inventor: Ralph Arroyo, 14354 Jennings Vista Way, Lakeside, Calif. 92040-5829

[21] Appl. No.: 194,304

[22] Filed: Jan. 31, 1994

[51] Int. Cl.[5] ..... B42D 3/00

[52] U.S. Cl. ..... 281/31; 281/29; 281/30; 281/51; 402/73; 402/80 R; 402/4

[58] Field of Search ..... 281/29, 31, 37, 51, 281/28, 30; 402/70, 73, 80 R, 4

[56] References Cited

U.S. PATENT DOCUMENTS 1,848,980 3/1932 Walker ..... 281/31 X 4,629,349 12/1986 Pitts ..... 281/31 X

*Primary Examiner*—Willmon Fridie

*Attorney, Agent, or Firm*—Michael J. Colitz, Jr.

[57] ABSTRACT

A loose leaf binder for holding papers and supplies comprising a top cover having an exterior surface and an interior surface; a bottom cover having an exterior surface and an interior surface; a spine having an exterior surface and an interior surface; a hinge mechanism connecting the spine to the top cover and the spine to the bottom cover; a retaining mechanism coupled to the interior surface of the spine for holding papers; and a storage compartment coupled to the exterior surface of the spine for holding writing supplies therein.

2 Claims, 3 Drawing Sheets

FIG. 1
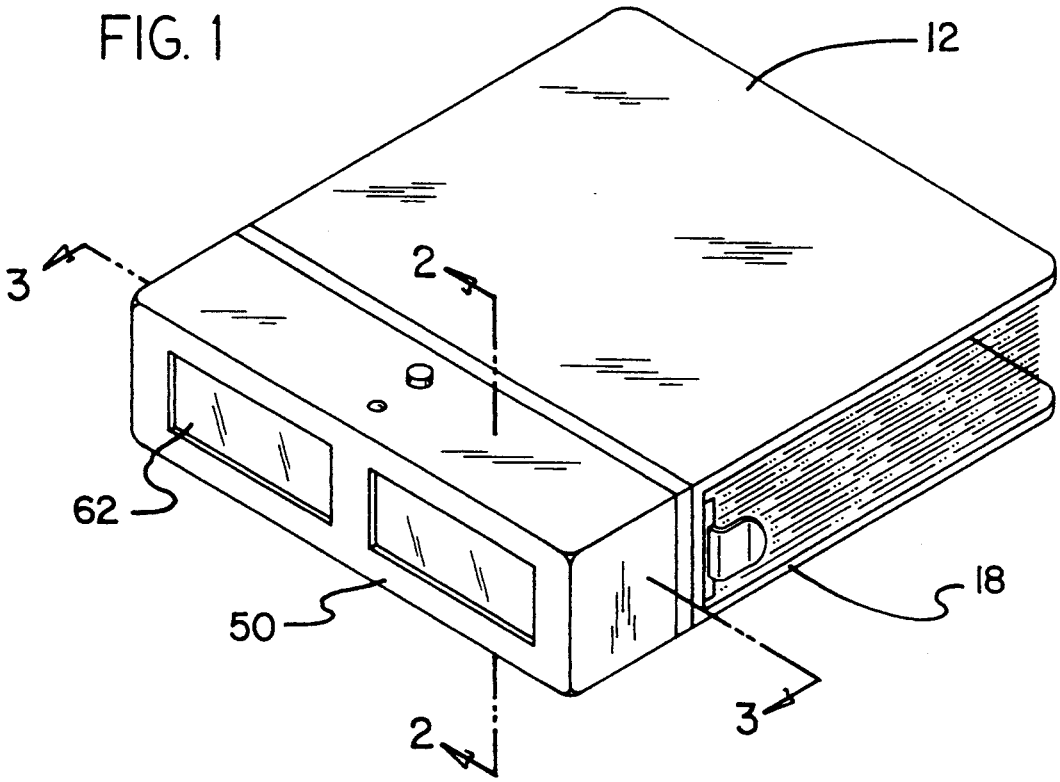
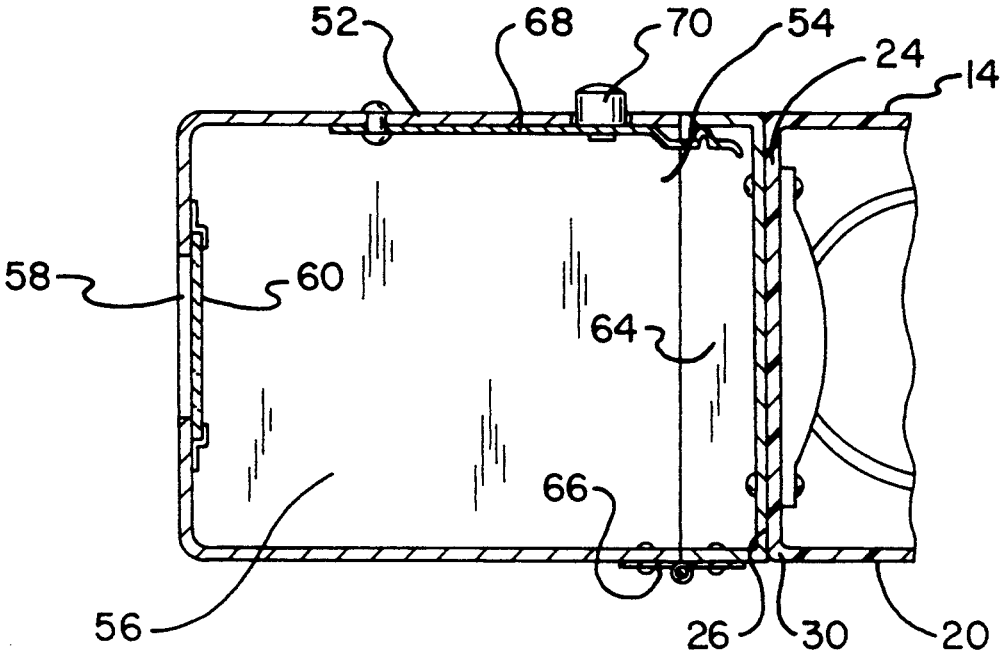
FIG. 2

FIG. 3
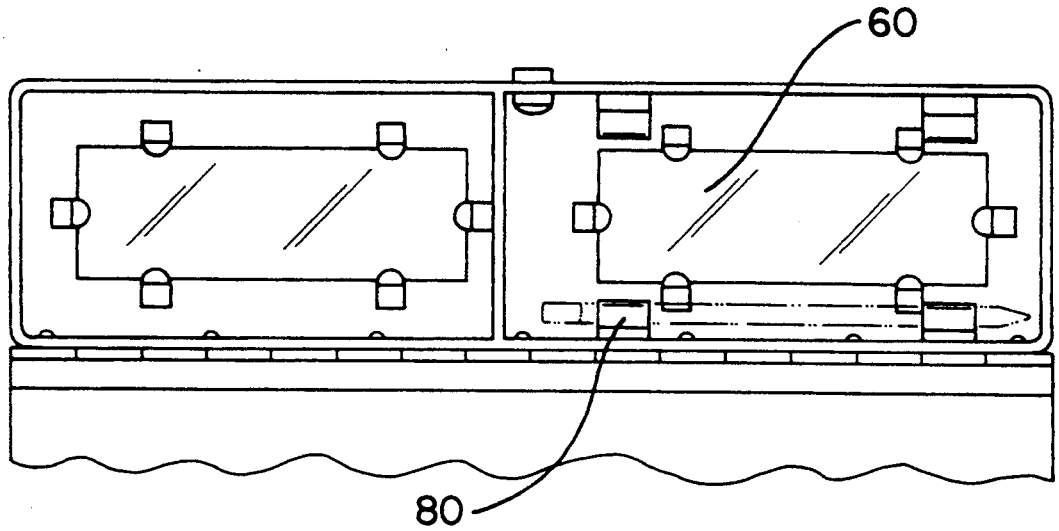
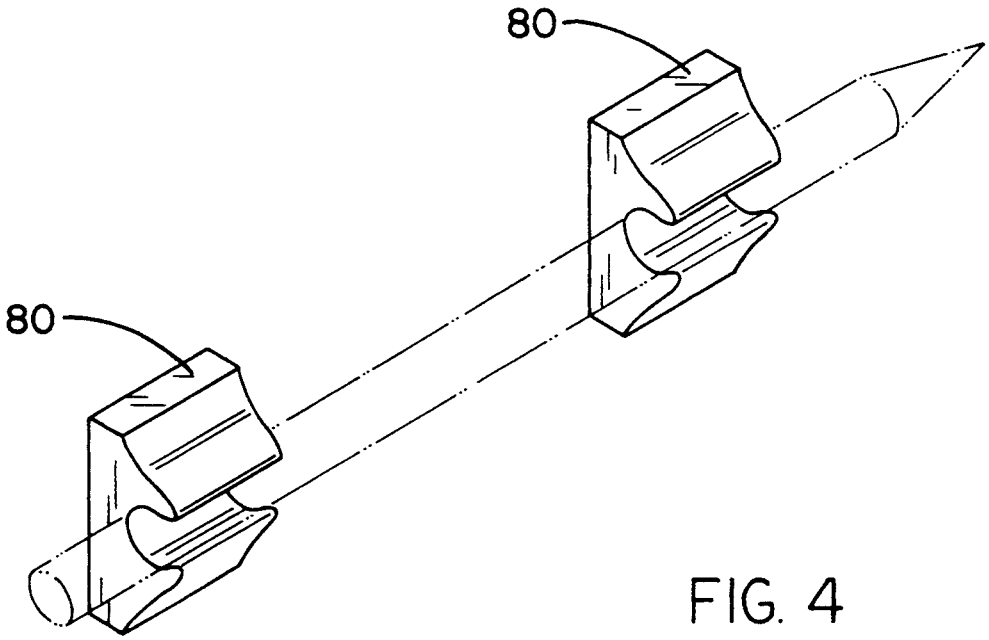
FIG. 4

FIG. 5
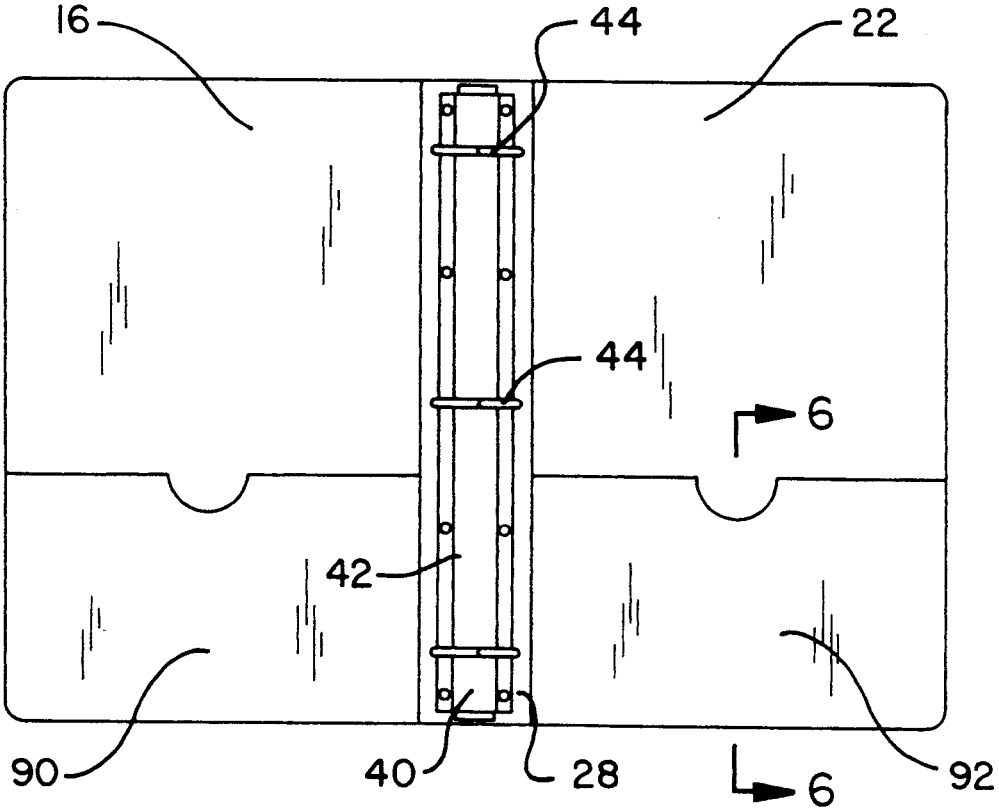
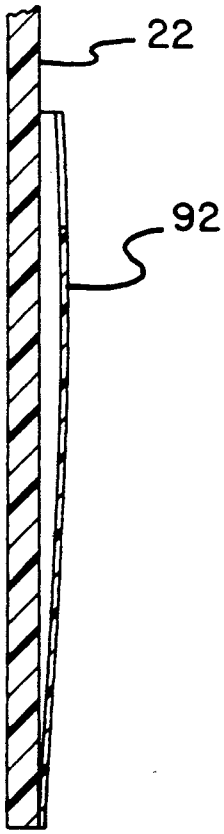
FIG. 6

LOOSE LEAF BINDER

BACKGROUND OF THE INVENTION

1. Field of the Invention

The present invention relates to a loose leaf binder and more particularly pertains a loose leaf binder for holding loose leaf papers and writing supplies.

2. Description of the Prior Art

The use of binders is known in the prior art. More specifically, binders heretofore devised and utilized for the purpose of holding papers are known to consist basically of familiar, expected and obvious structural configurations, not-withstanding the myriad of designs encompassed by the crowded prior art which have been developed for the fulfillment of countless objectives and requirements.

By way of example, U.S. Pat. No. 3,670,370 to Goodwin discloses a clip board with pencil holder, 4,555,018 to Cho discloses a portable folder type pencil case, 4,614,450 to Neiman discloses a portable index card holder for notebooks, 5,042,841 to Friedman discloses a combined cover and storage compartment for a ring binder, and 5,058,736 to Bedol discloses a notebook organizer including slidable element.

While these devices fulfill their respective, particular objective and requirements, the aforementioned patents do not describe a loose leaf binder that has a storage compartment having a plurality of windows disposed thereon for allowing the contents of the compartment to be viewed.

In this respect, the loose leaf binder according to the present invention substantially departs from the conventional concepts and designs of the prior art, and in doing so provides an apparatus primarily developed for the purpose of holding loose leaf papers and writing supplies.

Therefore, it can be appreciated that there exists a continuing need for new and improved loose leaf binder which can be used for holding loose leaf papers and writing supplies. In this regard, the present invention substantially fulfills this need.

SUMMARY OF THE INVENTION

In the view of the foregoing disadvantages inherent in the known types of binders now present in the prior art, the present invention provides an improved loose leaf binder. As such, the general purpose of the present invention, which will be described subsequently in greater detail, is to provide a new and improved loose leaf binder and method which has all the advantages of the prior art and none of the disadvantages.

To attain this, the present invention essentially comprises, in combination: a generally rectangular and planar top cover having an exterior surface and an interior surface; a generally rectangular and planar bottom cover having an exterior surface and an interior surface; a generally rectangular and planar spine having an exterior surface and an interior surface; hinge means connecting the spine at one edge to the top cover and the spine at an opposed edge to the bottom cover; a ring assembly having a base with a plurality of spaced rings formed thereon and coupled to the interior surface of the spine for holding loose leaf papers; a storage compartment for holding writing supplies further comprising a container having a central opening and a space therein, the container further having a plurality of apertures disposed thereon with transparent film disposed therein thus creating windows for allowing the space to be viewed; a lid coupled to the exterior surface of the spine for sealing the central opening of the container; a hinge rotatably coupling the container with the lid; and a latch coupled to the container and extending therefrom for enabling the lid to be secured over the central opening, the latch having a button formed thereon extending through the container, thus allowing the latch to be released for opening the storage compartment when the button is pushed inwards.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved loose leaf binder which has all the advantages of the prior art binders and none of the disadvantages.

It is another object of the present invention to provide a new and improved loose leaf binder which may be easily and efficiently manufactured and marketed.

It is a further object of the present invention to provide a new and improved loose leaf binder which is of durable and reliable construction.

An even further object of the present invention is to provide a new and improved loose leaf binder which is susceptible of a low cost of manufacture with regard to both materials and labor, and which accordingly is then susceptible of low prices of sale to the consuming public, thereby making such a loose leaf binder economically available to the buying public.

Still yet another object of the present invention is to provide a new and improved loose leaf binder which provides in the apparatuses and methods of the prior art some of the advantages thereof, while simultaneously overcoming some of the disadvantages normally associated therewith.

Even still another object of the present invention is to provide a new and improved loose leaf binder for holding loose leaf papers and writing supplies.

Even still another object of the present invention is to provide a new and improved loose leaf binder Even still another object of the present invention is to provide a new and improved loose leaf binder that can be adapted to hold any type and size of paper therein.

Even still another object of the present invention is to provide a new and improved loose leaf binder that has a storage compartment which can hold pencils, pens, erasers, ink cartridges, paper clips, rubber bands, and other miscellaneous writing supplies.

Even still another object of the present invention is to provide a new and improved loose leaf binder that has a storage compartment coupled thereto adapted to hold small items so that they do not get lost.

Even still another object of the present invention is to provide a new and improved loose leaf binder that has a storage compartment with a plurality of windows mounted thereon for viewing the contents thereof.

Even still another object of the present invention is to provide a new and improved loose leaf binder that contains a storage compartment which can be closed on all sides to hold and protect items placed therein yet provide easy access thereto when desired.

Lastly, it is an object of the present invention is to provide a new and improved loose leaf binder comprising a top cover having an exterior surface and an interior surface; a bottom cover having an exterior surface and an interior surface; a spine having an exterior surface and an interior surface; hinge means connecting the spine to the top cover and the spine to the bottom cover; retaining means coupled to the interior surface of the spine for holding papers; and a storage compartment coupled to the exterior surface of the spine for holding writing supplies therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the loose leaf binder constructed in accordance with the principles of the present invention.

FIG. 2 is a view of the storage compartment taken along the line 2—2 of FIG. 1.

FIG. 3 is a view of the windows on the storage compartment taken along the line 3—3 of FIG. 1.

FIG. 4 is a view of the clips used to hold writing utensils within the storage compartment of the present invention.

FIG. 5 is a view of the pockets coupled to the interior surface of both the top and bottom covers constructed in accordance with an alternate embodiment of the present invention.

FIG. 6 is a view of a pocket taken along the line 6—6 of FIG. 5.

The same reference numerals refer to the same parts through the various Figures.

DESCRIPTION OF THE PREFERRED EMBODIMENT

With reference now to the drawings, and in particular, to FIG. 1 thereof, the preferred embodiment of the new and improved loose leaf binder embodying the principles and concepts of the present invention and generally designated by the reference number 10 will be described.

Specifically, the present invention includes nine major components. The major components are the top cover, the bottom cover, the spine, hinge means, a ring assembly, a storage compartment, a lid, a hinge, and a latch. These components are interrelated to provide the intended function.

More specifically, it will be noted in the various Figures that the first major component is the top cover 12. The top cover is generally rectangular and planar in form. The top cover has an exterior surface 14 and an interior surface 16.

The second major component is the bottom cover 18. The bottom cover is generally rectangular and planar in form. The bottom cover includes an exterior surface 20 and an interior surface 22.

The third major component is the spine 24. The spine is generally rectangular and planar in form. The spine includes an exterior surface 26 and an interior surface 28.

The fourth major component is the hinge means 30. The hinge means connects the spine at one edge to the top cover 12. The hinge means also connects the spine at an opposed edge to the bottom cover 18. The hinge means can take the form of a hinge or be formed as an integral member coupled between the spine and the covers.

The fifth major component is the ring assembly 40. The ring assembly has a base 42 with a plurality of spaced rings 44 formed thereon. The assembly is coupled to the interior surface 28 of the spine. The ring assembly is adapted to hold loose leaf papers therein.

The sixth major component is the storage compartment 50. The storage compartment is used to hold writing supplies. The storage compartment includes a container 52 having a central opening 54 and a space 56 therein. The container further includes a plurality of apertures 58 disposed thereon. Transparent film 60 is disposed within the apertures, thus creating windows 62 for allowing the space and contents of the container to be viewed.

The seventh major component is the lid 64. The lid is coupled to the exterior surface 26 of the spine. The lid is used to seal the central opening 54 of the container, thus preventing access to the space 56.

The eighth major component is the hinge 66. The hinge rotatably couples the container 52 with the lid 64. The hinge is thus used in conjunction with the lid for allowing or preventing access to the space 56.

The ninth major component is a latch 68. The latch is coupled to the container and a portion extends therefrom through the central opening 54 for enabling the lid 64 to be secured to the container. The latch includes a button 70 formed thereon. The button extends through the container and allows the latch to be released for opening the storage compartment when the button is pushed inwards.

A second embodiment of the present invention is shown in FIGS. 3 and 4 and includes substantially all of the components of the present invention further including a plurality of retainer clips 80. The retainer clips are coupled within the storage container. They are positioned for removably holding writing utensils therein in a stowed configuration for ready access.

A third embodiment of the present invention is shown in FIGS. 5 and 6 and includes substantially all of the components of the present invention further including a first pocket 90 and a second pocket 92. The first pocket is coupled to the interior surface 16 of the top cover. The second pocket is coupled to the interior surface 22 of the bottom cover. Each pocket is adapted for holding loose leaf papers, envelopes, and other writing supplies therein.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A loose leaf binder for holding loose leaf papers and writing supplies comprising, in combination:

a generally rectangular and planar top cover having an exterior surface and an interior surface;

a generally rectangular and planar bottom cover having an exterior surface and an interior surface;

a generally rectangular and planar spine having an exterior surface and an interior surface;

hinge means connecting the spine at one edge to the top cover and the spine at an opposed edge to the bottom cover;

a ring assembly having a base with a plurality of spaced rings formed thereon and coupled to the interior surface of the spine for holding loose leaf papers;

a storage compartment for holding writing supplies further comprising a container having a central opening and a space therein, the container further having a plurality of apertures disposed thereon with transparent film disposed therein thus creating windows for allowing the space to be viewed;

a lid coupled to the exterior surface of the spine for sealing the central opening of the container;

a hinge rotatably coupling the container with the lid; and a latch coupled to the container and extending therefrom for enabling the lid to be secured over the central opening, the latch having a button formed thereon extending through the container, thus allowing the latch to be released for opening the storage compartment when the button is pushed inwards.

2. A loose leaf binder for holding papers and supplies comprising:

a top cover having an exterior surface and an interior surface;

a bottom cover having an exterior surface and an interior surface;

a spine having an exterior surface and an interior surface;

hinge means connecting the spine to the top cover and the spine to the bottom cover;

retaining means coupled to the interior surface of the spine for holding papers; and a storage compartment having a hollow interior coupled to the exterior surface of the spine for holding writing supplies therein;

a plurality of aligned retainer clips coupled to the storage compartment adjacent to the interior thereof for removably holding writing utensils therein in a stowed position for ready access; and a first pocket coupled to the interior surface of the top cover and a second pocket coupled to the interior surface of the bottom cover, each pocket adapted for holding loose leaf papers, envelopes, and other writing supplies therein for ready access.

* * * * *